US010252105B2

(12) United States Patent
Dickens

(10) Patent No.: US 10,252,105 B2
(45) Date of Patent: Apr. 9, 2019

(54) IRON GRIP

(71) Applicant: Edward Via College of Osteopathic Medicine, Blacksburg, VA (US)

(72) Inventor: Brian Andrew Dickens, Salem, VA (US)

(73) Assignee: Edward Via College of Osteopathic Medicine, Blacksburg, VA (US)

( * ) Notice: Subject to any disclaimer, the term of this patent is extended or adjusted under 35 U.S.C. 154(b) by 0 days.

(21) Appl. No.: 15/080,775

(22) Filed: Mar. 25, 2016

(65) Prior Publication Data

US 2016/0279467 A1 Sep. 29, 2016

Related U.S. Application Data

(60) Provisional application No. 62/137,970, filed on Mar. 25, 2015.

(51) Int. Cl.

| | |
|---|---|
| ***A63B 21/00*** | (2006.01) |
| ***A63B 21/04*** | (2006.01) |
| ***A63B 21/072*** | (2006.01) |
| ***A63B 23/02*** | (2006.01) |
| ***A63B 23/035*** | (2006.01) |
| ***A63B 23/10*** | (2006.01) |
| ***A63B 23/12*** | (2006.01) |
| ***A63B 23/14*** | (2006.01) |
| ***A63B 23/16*** | (2006.01) |
| ***A63B 24/00*** | (2006.01) |
| ***A63B 69/00*** | (2006.01) |

(52) U.S. Cl.

CPC ..... *A63B 23/16* (2013.01); *A63B 21/0442* (2013.01); *A63B 21/072* (2013.01); *A63B 21/151* (2013.01); *A63B 21/4017* (2015.10); *A63B 23/03508* (2013.01); *A63B 21/00061* (2013.01); *A63B 21/00185* (2013.01); *A63B 23/0233* (2013.01); *A63B 23/0355* (2013.01); *A63B 23/10* (2013.01); *A63B 23/1218* (2013.01); *A63B 23/14* (2013.01); *A63B 24/0087* (2013.01); *A63B 2069/0006* (2013.01); *A63B 2209/00* (2013.01)

(58) Field of Classification Search

CPC ..... A63B 23/14–23/16; A63B 24/0087; A63B 21/4019; A63B 21/06; A63B 21/065; G09B 15/06

See application file for complete search history.

(56) References Cited

U.S. PATENT DOCUMENTS 1,736,930 A * 11/1929 Marsh ..... A63B 23/16 482/48
4,368,883 A * 1/1983 Tiktin ..... A63B 21/065 2/162
5,156,168 A * 10/1992 Canterna ..... A61F 5/05866 128/879

(Continued)

*Primary Examiner* — Jennifer M Deichl

(74) *Attorney, Agent, or Firm* — Keith A. Vogt; Vogt IP

(57) ABSTRACT

The present invention provides a system for training tendons and muscles of a kinetic chain including the finger tips through the elbow, including muscles, ligaments, and tendons. The system uses finger attachments to secure the digits or other anatomical components to one or more resistance members that allow the attachments to be positionable in any direction with respect to one another when a force is applied.

15 Claims, 7 Drawing Sheets

(56) References Cited

U.S. PATENT DOCUMENTS

| | | | | |
|---|---|---|---|---|
| 5,538,488 | A * | 7/1996 | Villepigue | A63B 21/0004 482/44 |
| 6,213,918 | B1 * | 4/2001 | Rogers, Jr. | A63B 21/0004 482/124 |
| 2011/0045953 | A1 * | 2/2011 | Poli | A63B 21/023 482/48 |
| 2014/0113779 | A1 * | 4/2014 | Loach | A63B 21/0004 482/115 |

* cited by examiner

IRON GRIP

RELATED APPLICATIONS

This application claims the benefit of U.S. Provisional Application No. 62/137,970 filed Mar. 25, 2015 and herein incorporated by reference.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

A sound and functional grip is needed for buttoning our shirts, tying our shoes and many other activities of daily living. Athletes need it to throw a fastball, catch a football, make a tackle, or climb a mountain. A stronger grip can improve performance and reduce risk of injury and allow us to function better in our daily lives. Unfortunately, most of the currently available strength-training equipment fail to adequately facilitate development of the neuromuscular pathways to accomplish dynamic hand strengthening and development of enhanced kinetic chain functional strength.

BRIEF SUMMARY OF THE INVENTION

In one embodiment, the present invention provides a device for developing both strength and stamina of the forearm musculature. The device operates in a manner that is more useful than prior devices since it is configured to facilitate dynamic strengthening in a real world manner.

In another embodiment, the present invention provides a device to increase the strength and stamina of the forearm musculature by transferring tension from the wrist to the fingertips in a manner that allows for a more useful real-life simulation to occur.

In other embodiments, the present invention provides a device that provides a means to exercise digits on one or both hands through the control of tension applied to each digit individually for the purpose of strengthening muscles in the hands and forearms and related physiological structures.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Figure 1:
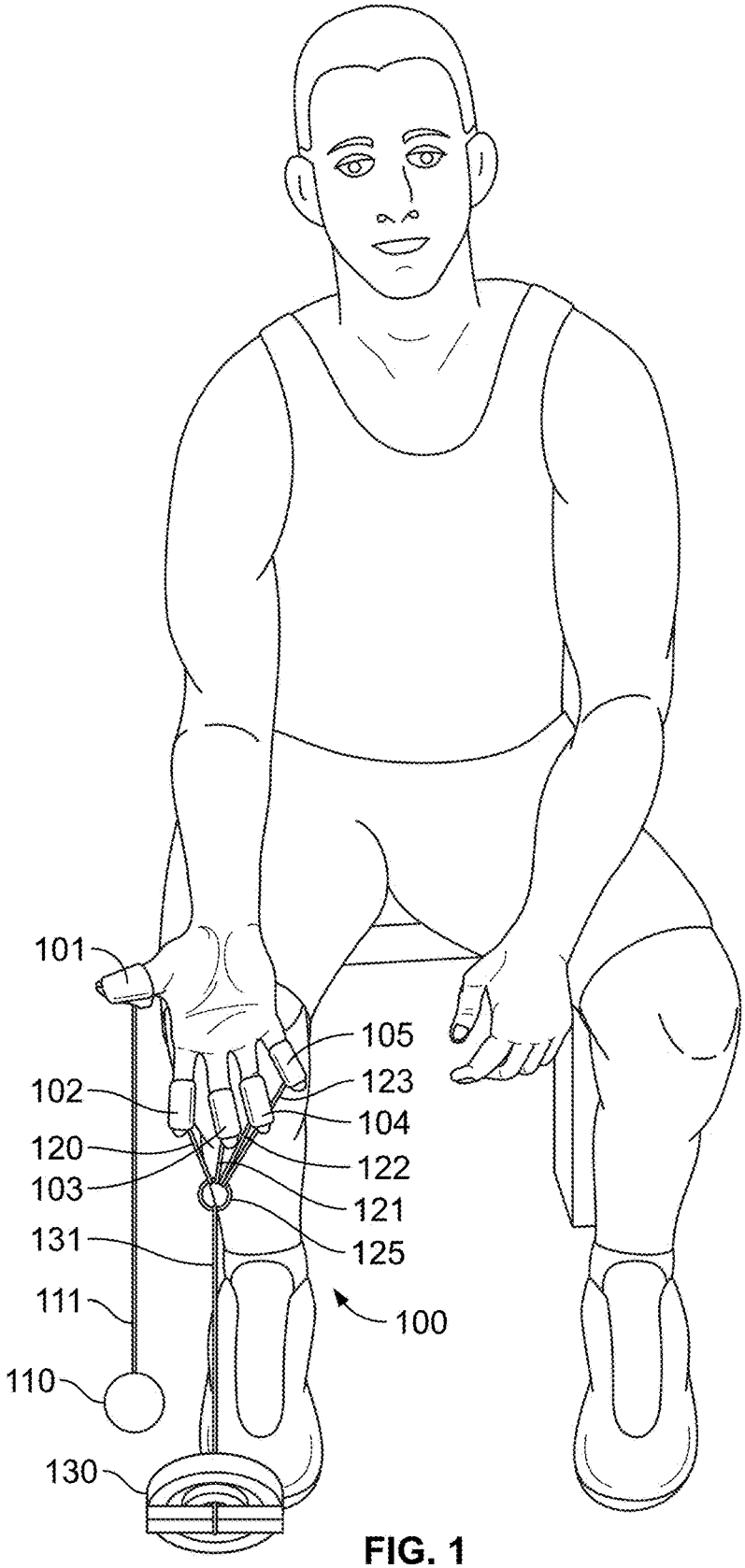
FIG. 1 shows one embodiment of the present invention with the hand of a user in a neutral position.

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

As shown in FIGS. 1-6, in one embodiment, the present invention provides a system 100 that is configured to the increase the strength and stamina of forearm musculature by transferring tension from the wrist to the fingertips in a manner that allows for a more useful real-life simulation to occur. In other embodiments, the present invention provides a device that provides a means to exercise digits on one or both hands, either collectively or individually, through the control of tension applied to each digit individually for the purpose of strengthening muscles in the hands and forearms and related physiological structures.

Device 100 is comprised of a plurality of finger attachments 101-105. Attachment 101, which affixes to the thumb, is connected to weight 110 by tension cord 111. Index finger attachment 102, middle finger attachment 103, ring finger attachment 104, and baby finger attachment 105, are individually attached by cords 120-123 which are connected to attachment point 125 which, in turn, is attached to weight 130 by cord 131. In addition, the thumb through attachment 101, may also be connected to weight 130 by coupler 125.

In yet other embodiments of the present invention, each finger attachment 101-105 may be connected individually to a resistance member for providing tension to each digit individually through a cord, cable or other attachment means capable of providing varying amounts of tension to the digits. In other embodiments, the resistance members transmit a fixed resistance. The resistance member may also include a primary weight and each individual finger resistance member 111 and 120-123 may apply secondary tension by the use of a spring or flexible member.

Figure 2:
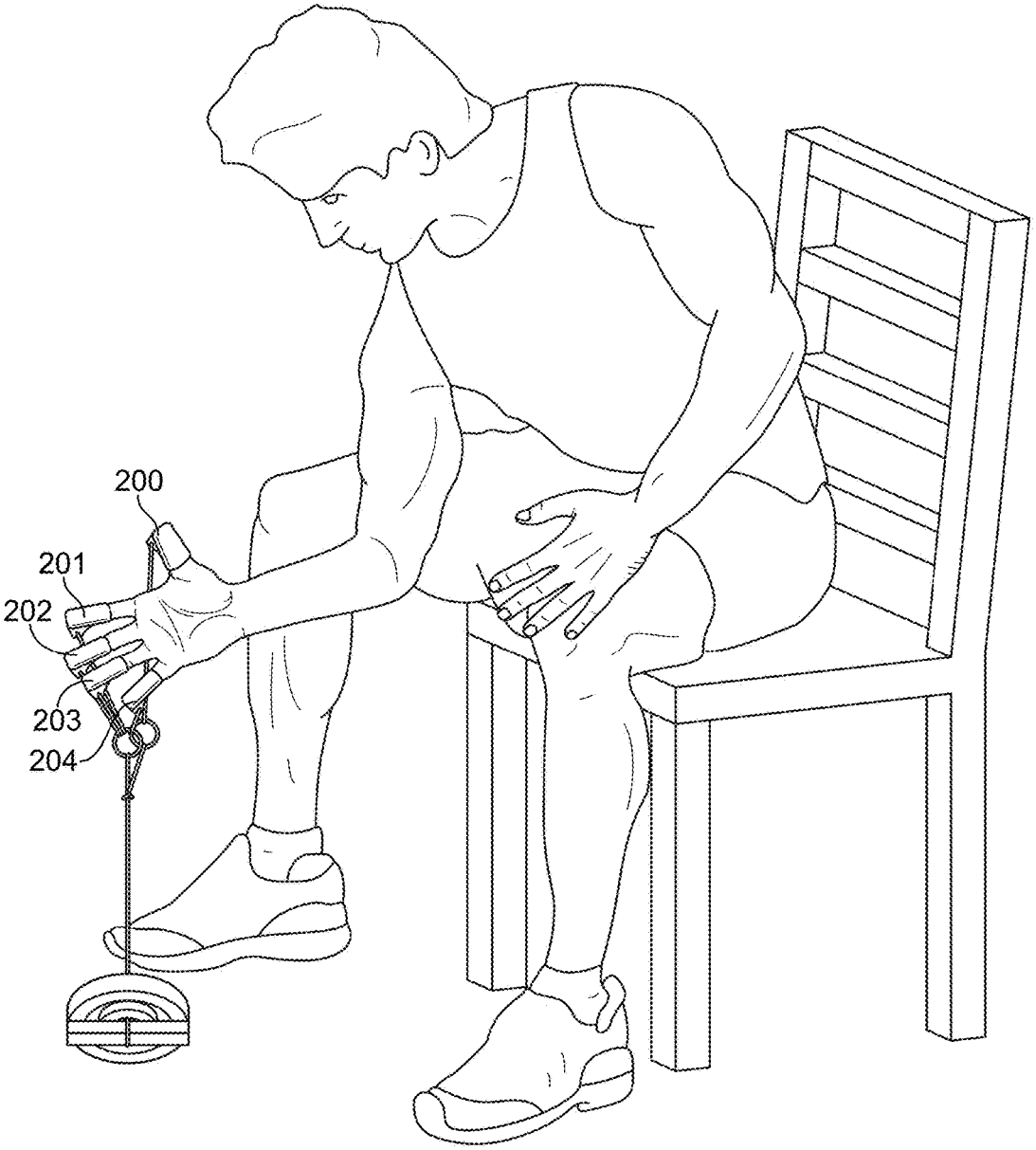
FIG. 2 shows the embodiment of FIG. 1 with the hand of the user in an extended position.
Figure 3:
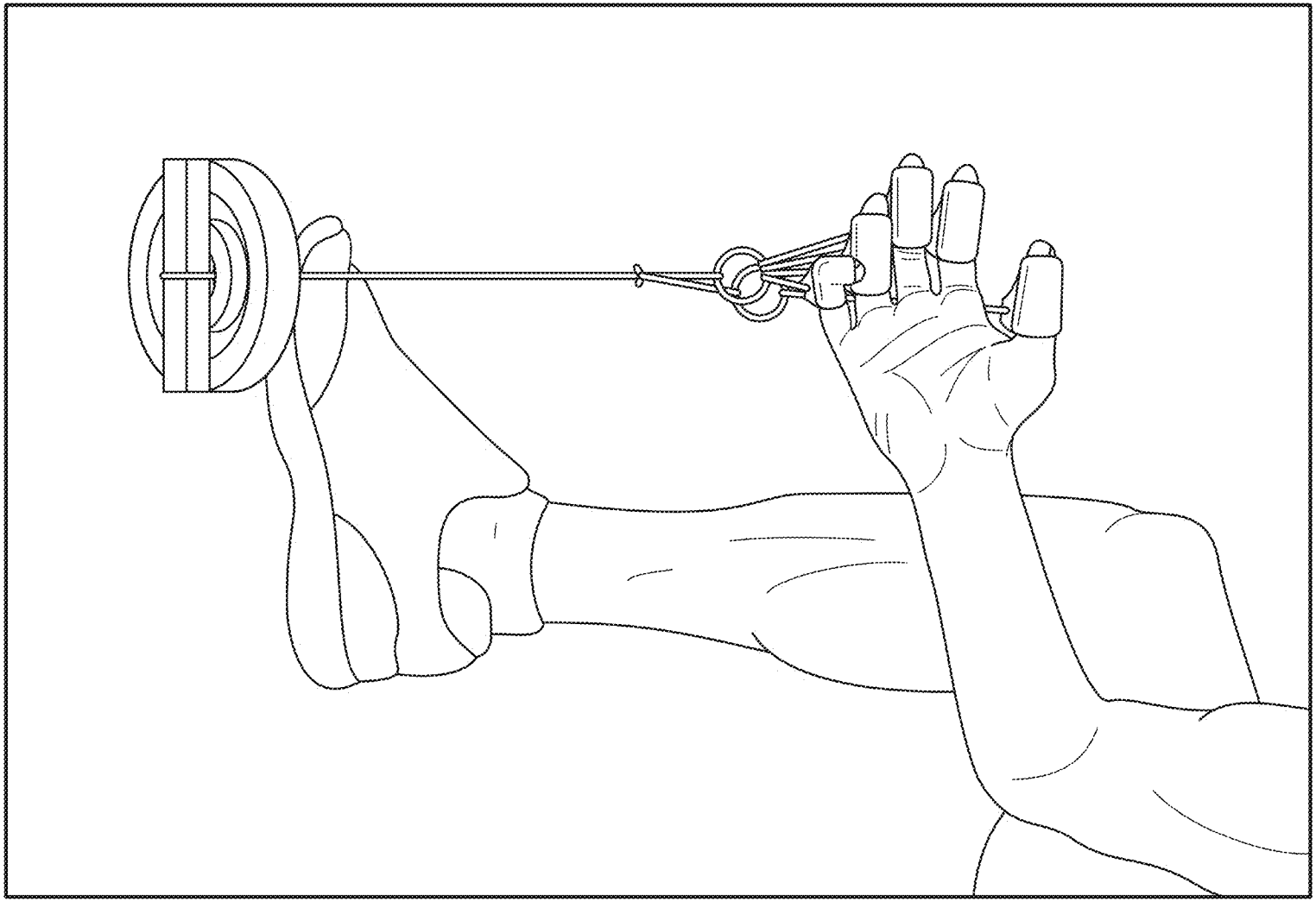
FIG. 3 shows the embodiment of FIG. 1 with the hand of the user in a partial flexion position.
Figure 4:
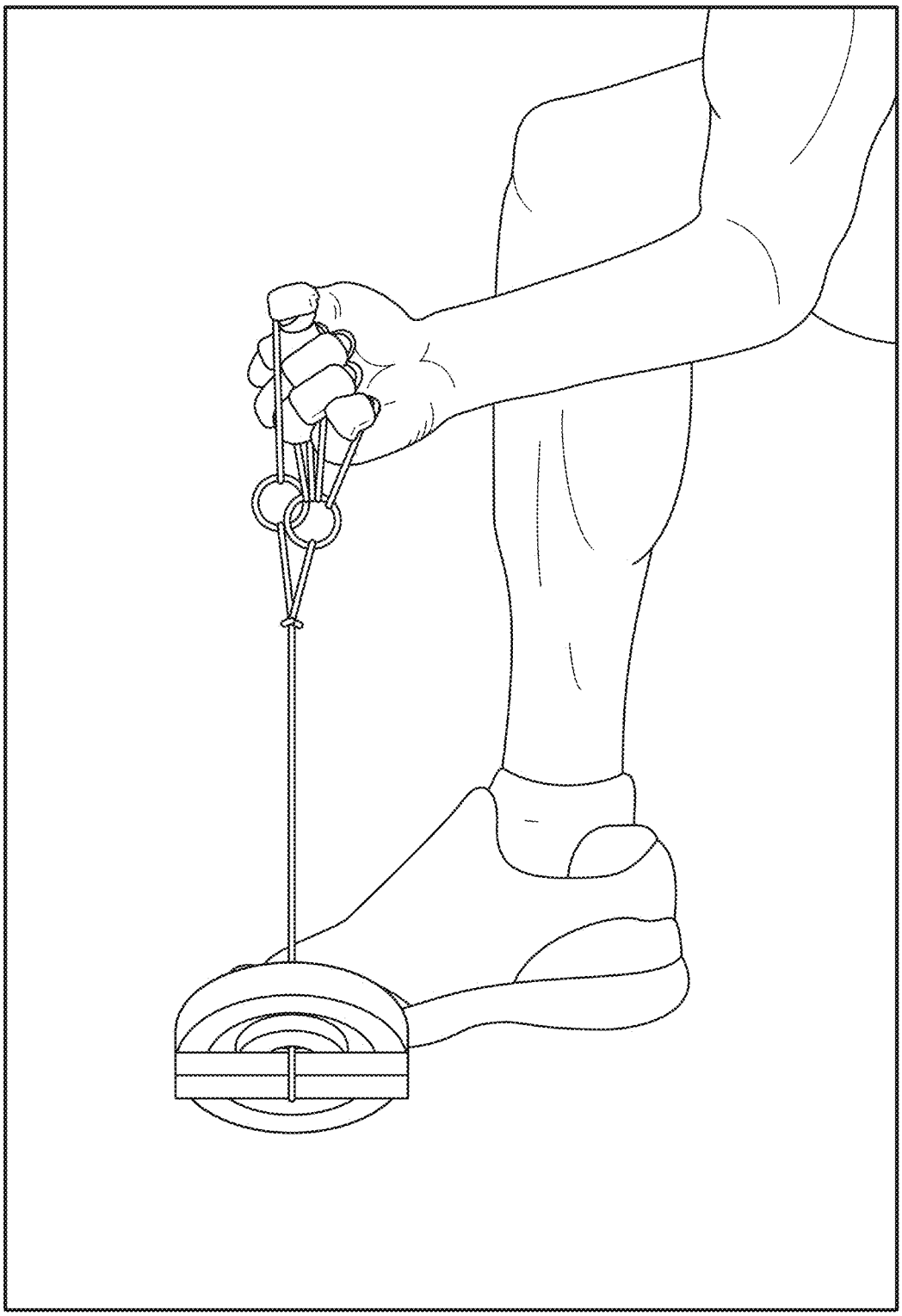
FIG. 4 shows the embodiment of FIG. 1 with the hand of the user in a partially cupped position.

In a preferred embodiment, the finger attachments comprise a cap, ring or similar means of connection to an individual digit, generally by slipping over the end of the digit. The cap or ring can be fabricated from any number of combinations of soft, semi-soft or hard materials such as leather, rubber, plastic, wood or metal. The purpose of the cap is to allow system 100 to apply tension to the distal end of the digit. A preferred location for attachments or caps 200-204 is the distal phalanx as shown in FIG. 2.

In further embodiments of the present invention, the cap is provided with a cord or other means attached preferably near the distal end of the digit and the cord is the principal means by which tension is applied to the digit. The cord may be fabricated from any suitable material that can effectively transmit tension to the digit through the attachment point on the finger attachment.

The attachment cords may be configured in a number of ways to create tension. In one embodiment of the present invention, the tensioning unit or member may be a weight or set of weights. The weights may be individually selected to supply a different tension to each digit, or a single weight can be attached to all the attachment cords simultaneously, thereby providing an essentially identical tension to each digit.

Figure 7:
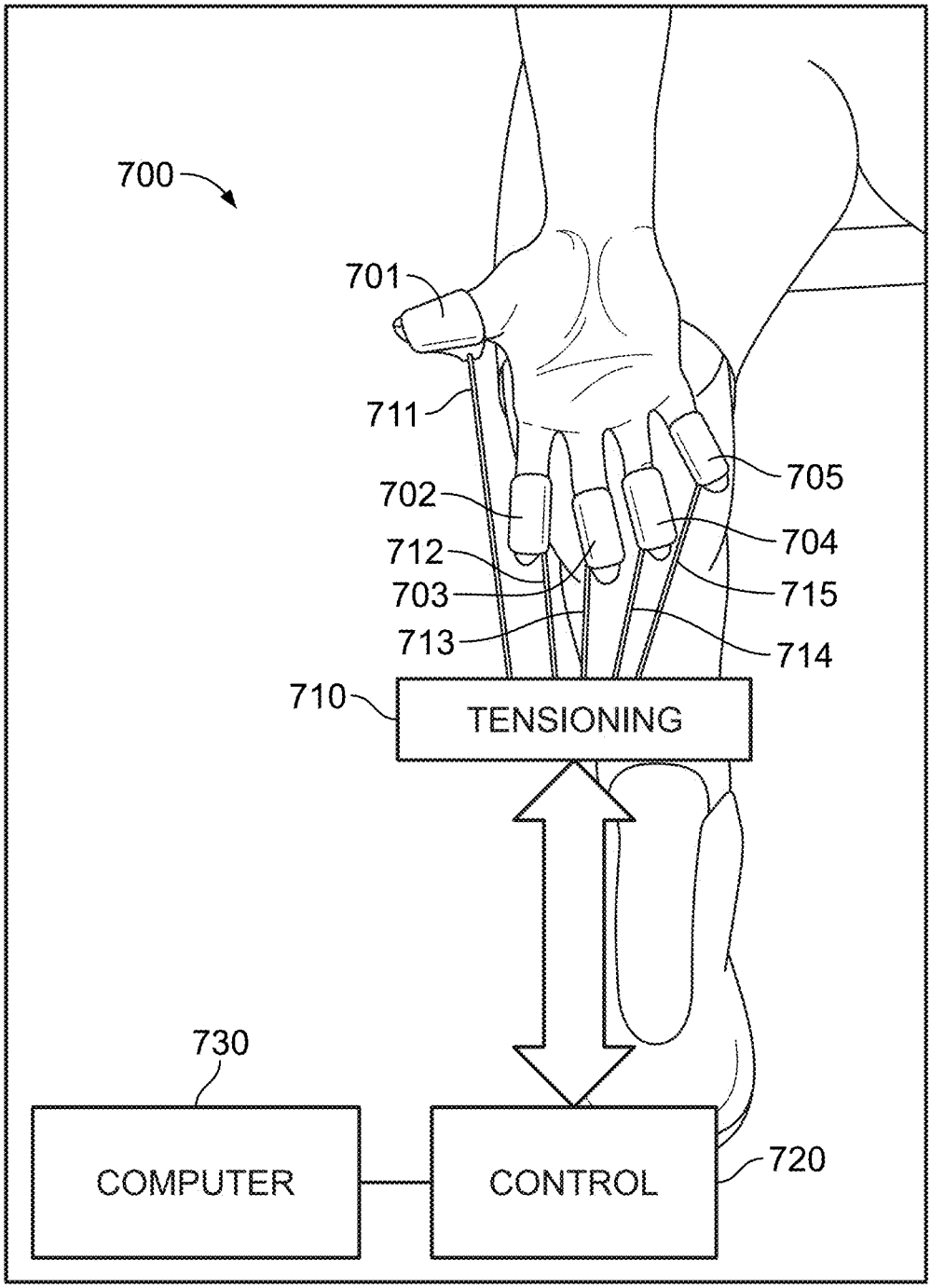
FIG. 7 illustrates another embodiment of the present invention.

In another embodiment of the present invention, as shown in FIG. 7, the tensioning unit may comprise an electromechanical device 700 with variable tension and sensor means for tracking the movement of each digit and the force applied to each digit. System 700 also includes attachments 701-705 for a user's digits. Tensioning system 700 may be configured to control the individual tension on each digit and provide feedback through a sensor attached to the attachment cords or tensioners 711-715, attachments 701-705 and/or within the tensioning unit 710. In one embodiment, tensioning unit 710 may be a single unit with attachment cord tension controlled from within the unit. In other embodiments, the tensioning and sensor means may be individual units attached to each attachment cord separately and independently. In other embodiments, tensioners 711-715 may be flexible or solid structures. As solid structures, tensioners 711-715 may be used to push, pull, and/or rotate digits.

In other aspects, system 700 includes a means by which the tension applied to each digit may be controlled through a computer or other programmable means to execute an exercise routine designed specifically to strengthen and/or train particular muscle groups in a pre-determined sequence. For this embodiment, system 700 comprises a control unit 720 and computer 730, or equivalent systems, which allow a user to load a pre-determined program of exercises into the system and apply appropriate tension to the digits in accordance with the desired exercise/strengthening routine. The computer and control unit may be separate units or may be combined into a single unit. The means by which the control is accomplished according to a predetermined exercise routine is chosen from any such means known to those skilled in the art.

In other embodiments, system 700 may be configured to communicate to the tensioning unit through electronic cables. In other embodiments, the communication may be via a wireless/radio-frequency means. Sensors that may be used include inertial sensors that wirelessly transmit information about gross and fine movements of the digits and/or other anatomical components.

In operation, a physician or physical therapist would load a program into an interface of system 700 that has been developed and programmed to exercise the digits of one or both hands in a predetermined sequence of tension values as a function of time and duration to produce a desired strengthening and/or training result. For a simplified embodiment of the present invention, a weight of predetermined value would be attached to the finger attachment cords while the user would perform a set of finger extensions and contractions according to the predetermined routine.

As shown in FIGS. 2-5, the present invention provides for movement of the digits without interference from the cords and weight or any other component of the system. This allows for unrestricted movement of the hand and digits in any direction for a complete physiological motion of the digits, hand, wrist and forearm. In a preferred embodiment, as shown, the patient is located in a seated position, with the forearm resting on the user's leg, with the wrist and hand in unobstructed position.

Figure 5:
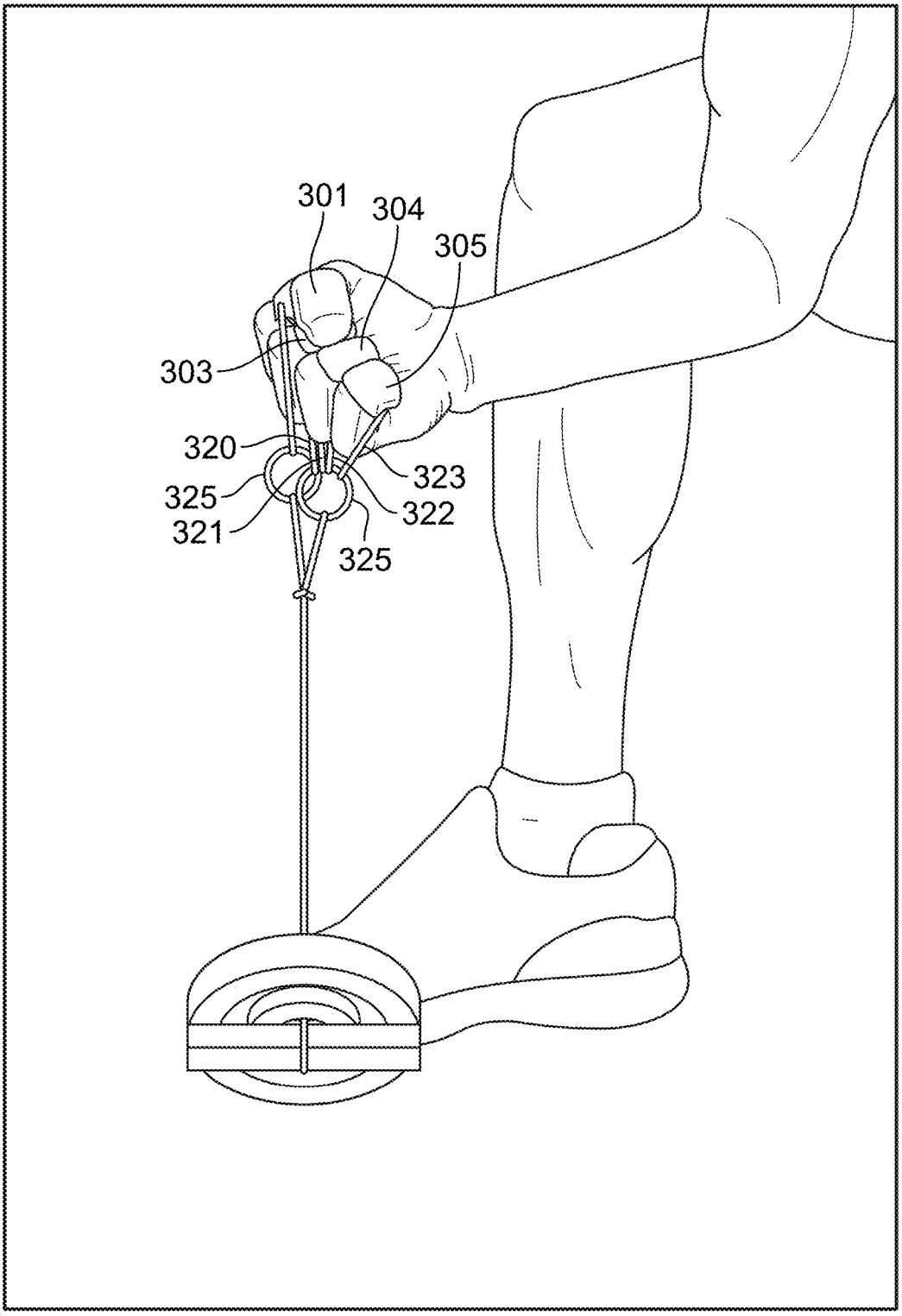
FIG. 5 shows the embodiment of FIG. 1 with the hand of the user in a fully cupped position.
Figure 6:
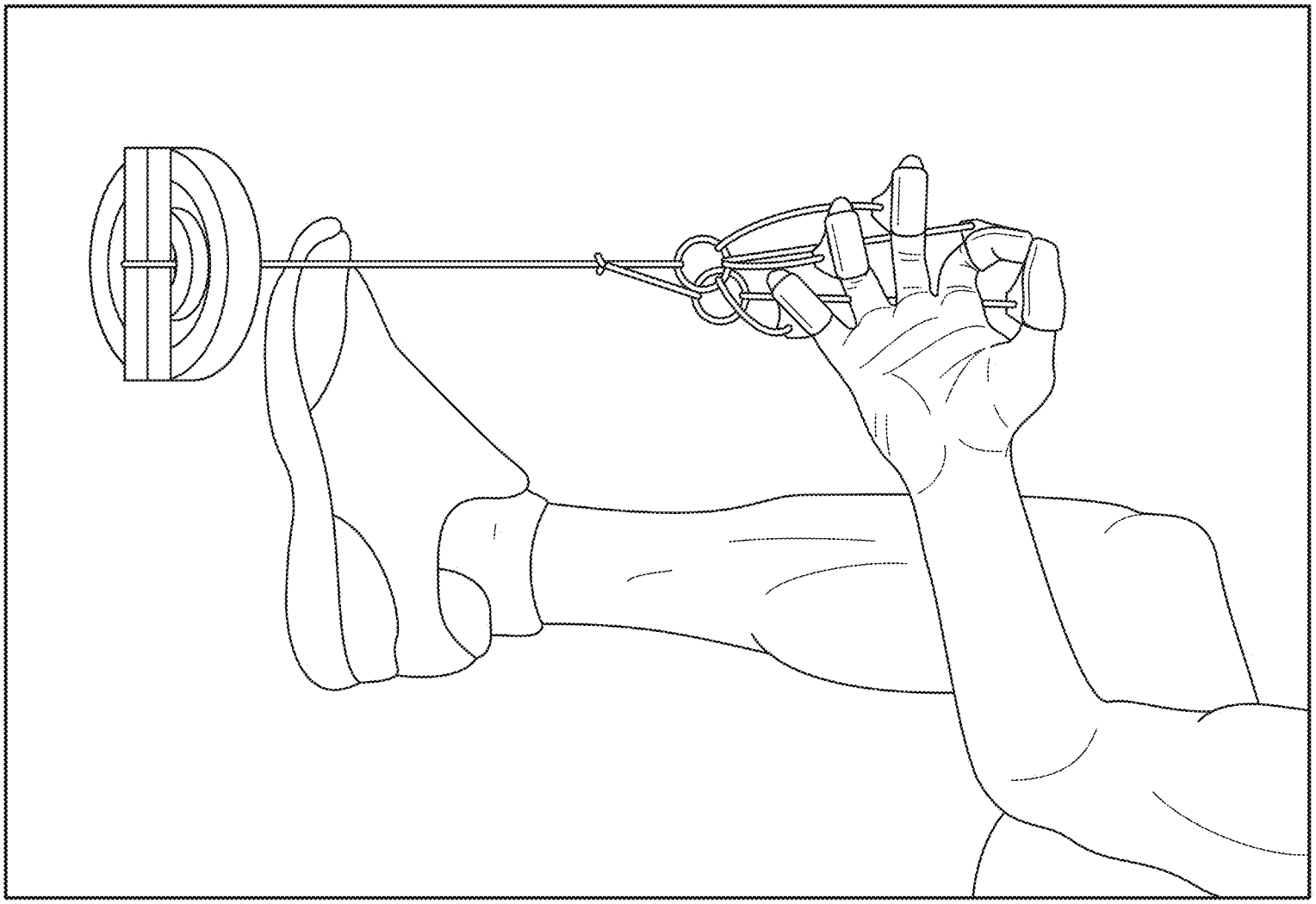
FIG. 6 shows another embodiment of present invention which allows a digit to be isolated and tensioned in a full range of movement that simulates a real-life movement.

While FIGS. 2-5 demonstrate a movement in which all four fingers are moved, FIG. 6 shows that individual digits may be engaged as well. In addition, in other embodiments, a user's thumb may be connected with the other digits by a cord connected to coupler 125. In a preferred embodiment, a user's thumb is independently coupled to a tensioning unit. Isolating the thumb is particularly beneficial when performing opposition movements.

As shown in FIGS. 5 and 6, the cords are adapted to allow a full range of motion by being able to interlace between a user's digits during use. For example, as shown in FIG. 5, when the hand is fully flexed, cords 322 and 323 are interlaced between digits 303-305 while thumb attachment 301 overlaps the other digits. In addition, as shown, the cords are of sufficient length to prevent coupler 325 from engaging a user's hand even when the hand is fully cupped. In this manner, cord 320 attach the second digit to the coupler and cord 321 attaches the third digit to the coupler.

Configuring the embodiments in this manner permits the device to engage and isolate small, deep muscles and ligaments within the hand, wrist and forearm. The components are also configured to permit a full range of movement without interference in any direction of use when one or more digits are engaged as shown in FIGS. 5 and 6.

For more complex configurations and uses, a system program may be used by a technician or the user, which program would then guide the exercise routine. For example, in addition to the flexor carpi radialis, flexor carpi ulnaris, and palmaris longus, which most wrist-flexion exercises address, the embodiments of the present invention may also target the flexor digitorum superficialis, flexor digitorum profundus, and flexor pollicis longus, which traditional exercises miss. Embodiments of the invention may also be used to target the pronator teres and pronator quadratus muscles with better dexterity by adding a pronating motion with tension on the fingertips rather than the wrist. Addressing the flexor digitorum profundus is especially important to pitchers, as a stronger flexor digitorum profundus muscle with better stamina is less likely to fatigue, causing offloading of its tension to the ulnar collateral ligament as the next point in the kinetic chain, thus potentially reducing the need for Tommy John surgeries.

In other embodiments, the present invention facilitates development of not only the extensor digitorum, extensor carpi radialis brevis, extensor carpi ulnaris, but also the extensor pollicis brevis and longus, extensor indicis, and extensor digiti minimi. In yet other embodiments, the present invention facilitates routines involving adduction, abduction and/or opposition. Areas addressed include, abductor pollicis longus, abductor pollicis brevis, adductor pollicis, palmar interossei (abduction) and dorsal interossei (adduction), opponens pollicis, and opponens digiti minimi.

The present invention and described embodiments may also be used for exercise regimens. An example regimen for strengthening muscles required to do delicate, but repetitive work, is the tendinitis protocol, which is derived from the studies of both Afredsson et al (1998), and the University of Alberta back pain study (2009).

Work flexion, extension, abduction, adduction, pronation, supination, and opposition may be utilized for improved performance or rehabilitation of injury by performing two sets of 12 repetitions with four second negatives (eccentric phase), four days per week. The exercises should make a user's forearms sore, but should not cause a burning sensation in the tendons.

In other embodiments, such as for competitive athletes, separate weight stacks with loads monitored via a computerized system may be engaged for individual digits. For other embodiments, a weight or weights attached via a rope or chain will suffice.

A further object of the invention is to provide a number of variations of the system having various degrees of complexity and cost so that the benefits of the exercise routine would be made available to the largest population of potential users. The embodiments of the present invention may be used in athletic training/sports and performance medicine, rehabilitation, general health, and prevention of injuries relating to the use of the hand/arm and related anatomical structures. Teachings of the present invention and any associated embodiments may also be used with other anatomical structures such as legs, feet, toes, back, shoulders, etc.—any physiological features of humans or animals for which such isolated exercise routines would be useful. Those devices are considered to be included in the invention herein described, and are made a part of this specification.

Neuromuscular means the training of particular anatomical components such as muscles, tendons etc. to perform in a manner dictated by the brain including balance, timing, distribution of velocity and force and resistance to fatigue.

In yet other embodiments, the present invention provides a system for training tendons and muscles, as well as other structures, of the upper extremity which may include the kinetic chain ranging from the finger tips through the elbow, including intervening muscles, ligament, tendons and supporting structures. For this embodiment, one or more finger attachments units are provided which may be, in a preferred embodiment, configured as one attachment unit per finger for a total of five. Each attachment unit is adapted to secure a finger in order to allow one or more resistance members to transmit a resistance to each of the attachment units. This, in turn, transmits resistance through the kinetic chain.

In other embodiments, the one or more finger attachments and the resistance members are configured to allow the finger attachments to be positionable in any direction, such as the XYZ-axis, with respect to one another, for allowing a user to individually exercise a least one finger on one hand such that the resistance members do not interfere with one another. In further embodiments, the present invention is adapted to load a fingertip force for any spatial vector for a full range of motion. For example, one or more fingers may be twirled while also encountering resistance that causes the finger to engage in a curling or extending pattern of movement. Thus, in one embodiment, the present invention is capable of applying an individual resistance and individual spatial vector to each finger, in any direction including rotating, pushing or pulling a finger in any direction using any combination of movements.

In addition, a controller is used. In a preferred embodiment, the controller is adapted to provide a combination of resistances and movements to each attachment point in accordance with a predetermined exercise routine. The predetermined routine may include repetitions, timed sequences and predetermined sequences.

In other aspects, the present invention provides a method for training tendons and muscles of the upper extremity including the kinetic chain extending from the finger tips through the elbow, muscles, ligament, tendons and supporting structures, In one embodiment, the method comprises the steps of applying a resistance to each of a user's fingers, the resistance is applied in any spatial vector. The method may also include the steps of repeating the application of resistance for a predetermined pattern of movement and repetitions. The pattern may include engaging the hand, wrist, and forearm and the resistance may increase or decrease in a predetermined manner. The pattern of movement may also change in a predetermined manner and the pattern of movement may include resistances such as a push, pull, or rotation in any spatial direction and in any combination of movements.

In other embodiments, the method includes positioning the fingers in a predetermined position with respect to one another and then changing the movement and finger positions over time. The pattern of movement includes resistance that may be a combination of push, pull, or rotation in any direction using any combination of movements.

Thus, the teachings of the present invention may be used to enable neuromuscular conditioning. By way of example, the present invention may be used to enable neuromuscular conditioning of a user's fingers, hand, wrist and forearm to enhance the user's ability to throw an improved fastball. For example, the spin imparted to a pitched ball influences its location or movement during travel. The present invention may be used to condition and teach the extremely gross and fine finger movements needed to neuromuscularly train and improve a user's pitching ability. Gross training typically involves engaging the entire kinetic chain. Fine movements involve specific anatomy and the timing when each anatomical component is engaged and the duration of engagement. In other embodiments, the present invention may be used to condition and train any desired movement.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiments, methods, and examples, but by all embodiments and methods within the scope and spirit of the disclosure.

What is claimed is:

1. A method for training the hand, wrist and forearm of a user including fingertips through an elbow, including muscles, ligaments, and tendons comprising the steps of:

attaching a plurality of finger attachments to the fingertips of the thumb, index, middle, ring and pinky fingers of a user;

connecting said finger attachments to one or more couplers by a plurality of finger attachment cords, said finger attachment cords are attached to said one or more couplers and said finger attachments;

attaching a weight to said one or more couplers by a weight attachment cord, said weight attachment cord connected to said one or more couplers and said weight;

positioning said weight in a position where said weight hangs below the fingertips to urge the fingers downwardly; and training the hand, wrist and forearm of a user including fingertips through an elbow, including muscles, ligaments, and tendons by moving said weight up and down along a vertical path.

2. The method of claim 1 wherein said training includes having the user make a fist while the wrist stays stationary while moving said weight up and down along a vertical path against gravity.

3. The method of claim 1 wherein said training includes having the user make a fist while curling the wrist while moving said weight up and down along a vertical path against gravity.

4. The method of claim 1 wherein said training includes having the user touch two or more fingertips together while moving said weight up and down along a vertical path against gravity.

5. The method of claim 1 wherein said training includes having the user move said weight up and down along a vertical path against gravity with one finger while the other fingers remain stationary.

6. The method of claim 1 wherein said training includes having the user touch the fingertips of the thumb and pinkly fingers together while moving said weight up and down along a vertical path against gravity.

7. A method for training the hand, wrist and forearm of a user including fingertips through an elbow, including muscles, ligaments, and tendons comprising the steps of:

attaching a plurality of finger attachments to the fingertips of the index, middle, ring and pinky fingers of a user;

connecting said finger attachments to one or more couplers by a plurality of finger attachment cords, said finger attachment cords are attached to said one or more couplers and said finger attachments;

attaching a first weight to said one or more couplers by a weight attachment cord, said weight attachment cord connected to said one or more couplers and said first weight;

positioning said first weight in a position where said first weight hangs below the fingertips to urge the fingers downwardly;

attaching a second weight to the thumb of a user;

positioning said second weight in a position where said second weight hangs below the thumb to urge the thumb downwardly; and training the hand, wrist and forearm of a user including fingertips through an elbow, including muscles, ligaments, and tendons by moving said weights up and down along a vertical path against gravity.

8. The method of claim 7 wherein said training includes having the user make a fist while the wrist stays stationary while moving said weights up and down along a vertical path against gravity.

9. The method of claim 7 wherein said training includes having the user make a fist while curling the wrist while moving said weighs up and down along a vertical path against gravity.

10. The method of claim 7 wherein said training includes having the user touch two or more fingertips together except for the thumb while moving said first weight up and down along a vertical path against gravity and said second weight remains stationary.

11. The method of claim 7 wherein said training includes having the user move said first weight up and down along a vertical path against gravity with one finger while the other fingers remain stationary and said second weight remains stationary.

12. The method of claim 7 wherein said training includes having the user touch the fingertips of the thumb and pinkly fingers together while moving said weights up and down along a vertical path against gravity.

13. The method of claim 7 wherein said training includes having the user touch the fingertips of the thumb and index fingers together while moving said weights up and down along a vertical path against gravity.

14. The method of claim 7 wherein said training includes having the user touch the fingertips of the thumb and middle fingers together while moving said weights up and down along a vertical path against gravity.

15. The method of claim 7 wherein said training includes having the user touch the fingertips of the thumb and ring fingers together while moving said weights up and down along a vertical path against gravity.

* * * * *